US006288648B1

(12) United States Patent
Easter et al.

(10) Patent No.: US 6,288,648 B1
(45) Date of Patent: Sep. 11, 2001

(54) APPARATUS AND METHOD FOR DETERMINING A NEED TO CHANGE A POLISHING PAD CONDITIONING WHEEL

(75) Inventors: William G. Easter; John A. Maze; Frank Miceli; Yifeng W. Yan, all of Orlando, FL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/384,506

(22) Filed: Aug. 27, 1999

(51) Int. Cl.[7] ..... G08B 21/00

(52) U.S. Cl. ..... 340/635; 340/648; 257/618; 451/8; 438/689

(58) Field of Search ..... 340/635, 648, 340/664, 454; 451/8, 21; 257/618, 619, 730; 438/689, 690

(56) References Cited

U.S. PATENT DOCUMENTS 5,664,987 * 9/1997 Renteln ..... 451/21
6,074,287 * 6/2000 Miyaji et al. ..... 451/287
6,091,130 * 7/2000 Oyamatsu et al. ..... 257/619

* cited by examiner

*Primary Examiner*—Edward Lefkowitz

(57) ABSTRACT

The present invention provides a method of manufacturing an integrated circuit using a conditioning wheel status indicator with a polishing apparatus having a conditioning wheel and a polishing pad. In one embodiment, the conditioning wheel status indicator comprises a drive motor, an ammeter, and an indicator. The drive motor is coupled to the conditioning wheel and configured to rotate the conditioning wheel against the polishing pad at a prescribed rotation rate. The ammeter is coupled to the drive motor and configured to measure a current of the drive motor. The current registered is a nominal current when the conditioning wheel is new. The indicator is coupled to the ammeter and configured to register an excess current that exceeds the nominal current when the conditioning wheel has incurred an undesirable degree of wear.

25 Claims, 4 Drawing Sheets

APPARATUS AND METHOD FOR DETERMINING A NEED TO CHANGE A POLISHING PAD CONDITIONING WHEEL

TECHNICAL FIELD OF THE INVENTION

The present invention is directed, in general, to a semiconductor wafer polishing apparatus and, more specifically, to an apparatus and method for determining when a semiconductor polishing pad conditioning wheel has reached its useable lifetime and requires replacement.

BACKGROUND OF THE INVENTION

Chemical mechanical planarization (CMP) is an essential process in the manufacture of semiconductor chips today. Dielectric and metal layers used in chip fabrication must be made extremely flat and of precise thickness in order to pattern the sub-micron sized features that comprise a semiconductor device. During CMP, the combination of chemical etching and mechanical abrasion produces the required flat, precise surface for subsequent depositions. The polishing pad is usually made of polyurethane and has small pores to carry the slurry under the wafer. As a result of the polishing process, pad material and slurry residues collect in the pores, plugging them, and reducing the polish rate due to slurry starvation. When the pad becomes clogged, it becomes necessary to "condition" the pad to restore its full functionality. That is, the accumulated material must be removed before it completely clogs the pad and results in a smooth, glazed surface that does not effectively polish the semiconductor wafer. A nickel/chromium conditioning wheel with a surface of diamond abrasives embedded in a nickel/chromium setting alloy is used to condition the pad. The conditioning wheel is pressed against the polishing pad by a conditioning wheel actuator, e.g., a hydraulic/pneumatic arm, and the polishing pad and conditioning wheel are each rotated at prescribed speeds while de-ionized water or slurry is flowed to rinse away abraded material. The diamond elements remove embedded particles, slurry, and polishing byproducts from the polishing pad. The conditioning proceeds until the pad is "re-surfaced" and new pores are exposed.

As the conditioning wheel is rotated against the polishing pad, the wheel, setting alloy, and the diamonds come in contact with the chemical/mechanical slurry. Conditioners for an oxide polisher have a useable lifetime of about 15,000 wafers. On the other hand, conditioners for a tungsten metal polisher have a useable lifetime of only about 5,000 to 7,000 wafers due to the abrasive nature of the metal polishing slurry. Conventionally, a polishing pad would be conditioned with the pad being rotated at a specific rate while the conditioner is rotated at another specified rate, the process continuing for a prescribed time; these parameters thereby constituting a recipe. Especially in metal polishing pads, problems developed when, after conditioning, the polishing pad does not perform up to expectations for polishing the next set of wafers. Of course, the initial analysis was that the pad was the problem, and the obvious solution was to replace the pad. After changing the polishing pad several times after minimal conditioning, it became apparent that the problem must not be the pad but rather that the conditioning wheel is not properly conditioning the pad. To resolve this problem of prematurely changing the pad, an empirical approach was developed to determine when the conditioner needs to be replaced, thus the above stated 5000 to 7000 wafers. This is, of course, only an approximation and almost certainly leads to early or late changing of the conditioner.

While the exact problem of why the conditioner loses effectiveness is not known, it is known that the slurries used to planarize metal layers, especially tungsten, are very corrosive and abrasive. Thus, one plausible explanation for the conditioner's loss of effectiveness is that the chemicals of the slurry may attack the nickel/chromium setting alloy and, over time, may loosen the diamond crystals, causing them to fall out of the polishing surface. Of course, this reduces the effective surface area of the conditioning wheel and slows the conditioning process. Alternatively, it may be that particles from the pad, used slurry, and metal particles are collecting between the diamond crystals, and building up until the crystals are ineffective. The end result is that the present methods are imprecise in determining when a change of the conditioning wheel is required.

Accordingly, what is needed in the art is an apparatus and method for determining with some precision when a conditioning wheel has served its useful life and requires replacement.

SUMMARY OF THE INVENTION

To address the above-discussed deficiencies of the prior art, the present invention provides a method of manufacturing an integrated circuit using a conditioning wheel status indicator with a polishing apparatus having a conditioning wheel and a polishing pad. In one embodiment, the conditioning wheel status indicator comprises a drive motor, an ammeter, and an indicator. The drive motor is coupled to the conditioning wheel and configured to rotate the conditioning wheel against the polishing pad at a prescribed rotation rate. The ammeter is coupled to the drive motor and configured to measure a current of the drive motor. The current registered is a nominal current when the conditioning wheel is new. The indicator is coupled to the ammeter and configured to register an excess current, which exceeds the nominal current, when the conditioning wheel has incurred an undesirable degree of wear.

Thus, in a broad sense, the present invention provides an apparatus and a method for determining when a polishing pad conditioning wheel has reached its useable lifetime. The useable lifetime is indicated by an increase in the amount of amperage needed to maintain rotation of the conditioning wheel at the prescribed rotation rate.

In another embodiment, the conditioning wheel status indicator further comprises a tachometer that is coupled to the drive motor and configured to measure a rotation rate of the drive motor. In a further aspect, the conditioning wheel status indicator further comprises a feedback loop coupled to the tachometer and to the drive motor. The feedback loop is configured to maintain the rotation rate at the prescribed rotation rate.

In an alternative embodiment, the excess current is about twice the nominal current. The excess current, in a more specific aspect, is about 1.7 times the nominal current.

In yet another embodiment, the conditioning wheel status indicator further comprises a platen tachometer, a platen motor, a platen ammeter, and a platen excess-amperage indicator. The platen motor is coupled to a polishing platen of the polishing apparatus and to the platen tachometer. The platen motor is configured to rotate the polishing platen at a prescribed platen rotation rate. The platen ammeter is coupled to the platen motor and configured to measure a platen motor current of the platen motor. The platen motor current is a nominal platen motor current when the conditioning wheel is new. The platen excess current indicator is coupled to the platen ammeter and is configured to register an excess platen motor current, which exceeds the nominal platen motor current, when the conditioning wheel has incurred an undesirable degree of wear.

In another embodiment, the conditioning wheel status indicator further comprises an excess current sensor and a rejection indicator light. The excess current sensor is configured to sense the current and to illuminate the rejection indicator light when the current equals or exceeds the excess current.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Devices for conditioning semiconductor polishing pads may vary in configuration, i.e., a solid wheel, a ring about the periphery of a carrier head, a drum, etc. For the purposes of this discussion, all such devices are inclusively referred to as a conditioning wheel.

Figure 1:
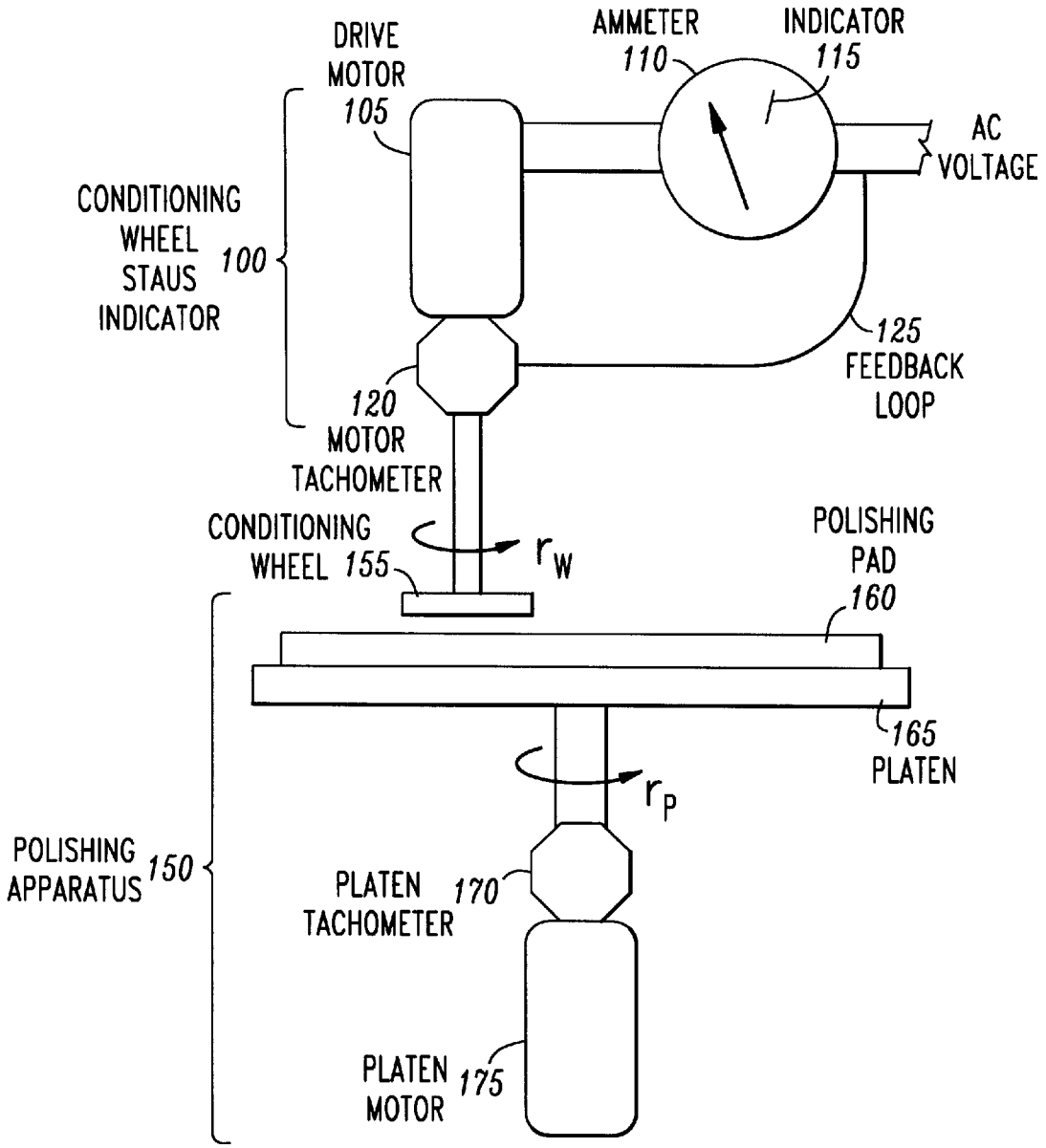
FIG. 1 illustrates an elevational view of one embodiment of a conditioning wheel status indicator coupled to a semiconductor wafer polishing apparatus.

Referring initially to FIG. 1, illustrated is an elevational view of one embodiment of a conditioning wheel status indicator 100 coupled to a semiconductor wafer polishing apparatus 150. The conditioning wheel status indicator 100 comprises a drive motor 105, an ammeter 110, an indicator 115, a motor tachometer 120, and a feedback loop 125. The polishing apparatus 150 comprises a conditioning wheel 155, a polishing pad 160, a platen 165, a platen tachometer 170, and a platen motor 175. The drive motor 105 is coupled to the conditioning wheel 155 and is configured to rotate the conditioning wheel 155 against the polishing pad 160 at a prescribed rotation rate $r_w$. The prescribed rotation rate $r_w$ is specified by the manufacturer of the polisher or the manufacturer of the conditioning wheel 155 in the form of a recipe for optimal conditioning of the polishing pad 160. The recipe may also specify a platen rotation rate $r_p$, and a conditioning time t.

The ammeter 110 is electrically coupled to the drive motor 105 and configured to measure a current i of the drive motor 105. When the conditioning wheel 155 is new, the current is a nominal current $i_n$ that may be, for example, 14 amperes. The indicator 115 is coupled to the ammeter 110 and permits comparison of the current i and an excess current $i_e$. As the conditioning wheel 155 wears, whether it be by accumulation of debris or by diamonds falling out, etc., the amperage i required to rotate the conditioning wheel 155 at the prescribed rotation rate $r_w$ is registered on the ammeter 110. When the conditioning wheel 155 has incurred an undesirable degree of wear, that is, the conditioning wheel 155 no longer adequately conditions the polishing pad 160, the ammeter 120 registers the excess current $i_e$. The excess current $i_e$ may be, for example, about twice the nominal current $i_n$, or about 28 amperes. In a more specific embodiment, the excess current may be 24 amperes or about 1.7 times the nominal current $i_n$. Of course, the nominal current $i_n$ and excess current $i_e$ may vary depending upon the manufacturer and nature of the conditioning wheel 155. When an operator observes the ammeter 110 registering a current i that equals or exceeds the excess current $i_e$, then the operator knows that the conditioning wheel 155 has reached its useful lifetime and must be replaced.

Figure 2:
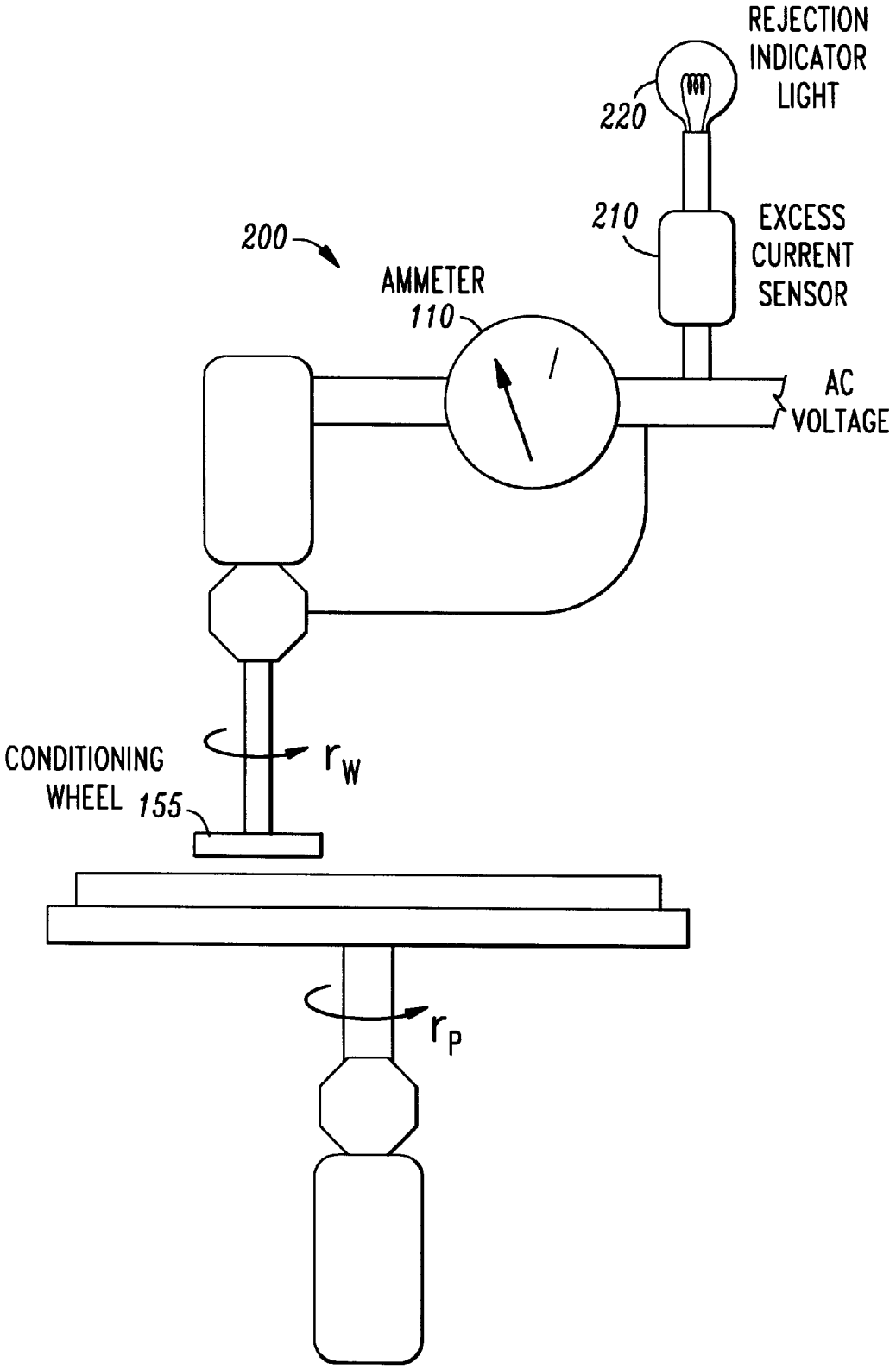
FIG. 2 illustrates an elevational view of an alternative embodiment of the conditioning wheel status indicator of FIG. 1.

Referring now to FIG. 2, illustrated is an elevational view of an alternative embodiment of the conditioning wheel status indicator of FIG. 1. In this embodiment, a conditioning wheel status indicator 200 further comprises an excess current sensor 210 and a rejection indicator light 220. The excess current sensor 210 is coupled to the ammeter 110 and configured to sense the current i. Upon sensing that the current i equals or exceeds the excess current $i_e$, the excess current sensor 210 illuminates the rejection indicator light 220. Thus, an operator may observe a visual alert that notifies him of the need to change the conditioning wheel 155.

Figure 3:
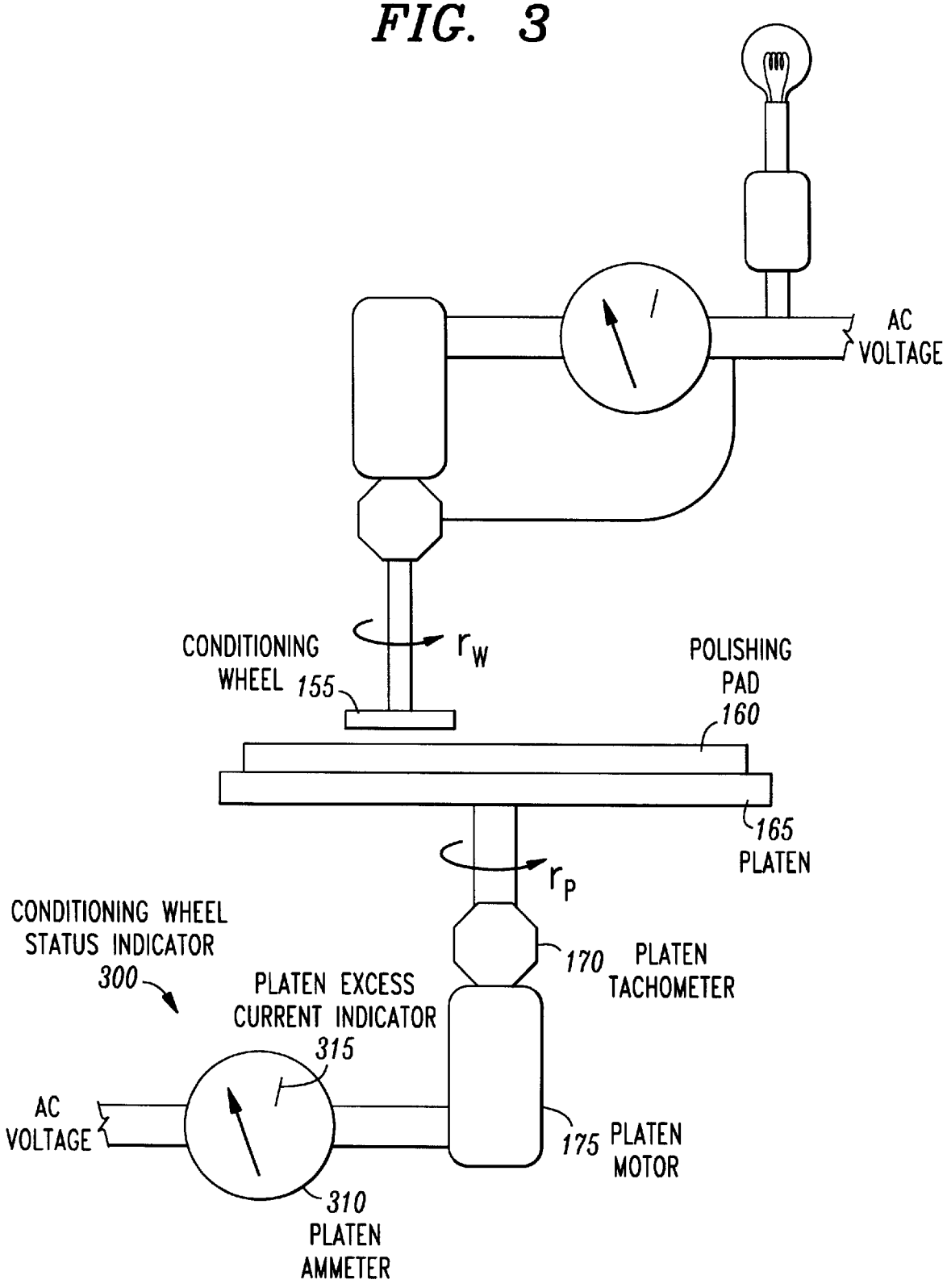
FIG. 3 illustrates an elevational view of a second alternative embodiment of the conditioning wheel status indicator of FIG. 1.

Referring now to FIG. 3, illustrated is an elevational view of a second alternative embodiment of the conditioning wheel status indicator of FIG. 1. In this embodiment, a conditioning wheel status indicator 300 further comprises a platen ammeter 310, a platen excess current indicator 315. The platen motor 175 is coupled to the polishing platen 165 and to the platen tachometer 170. The platen motor 175 is configured to rotate the platen 165 and the polishing pad 160 at a prescribed rotation rate $r_p$. The prescribed rotation rate $r_p$ is specified by the manufacturer of the conditioning wheel 155 in the form of a recipe for optimal conditioning of the polishing pad 160.

The platen ammeter 310 registers a platen motor current $i_p$. When the conditioning wheel 155 is new, the platen motor current $i_p$ is a nominal platen motor current $i_{pn}$. However, when the conditioning wheel 155 is worn, the platen motor current $i_p$ registers an excess platen motor current $i_{pe}$. Therefore, the operator may readily observe that the conditioning wheel 155 is worn to a point requiring replacement. The excess platen motor current $i_{pe}$ may be determined in a manner similar to that described above for an excess current $i_e$.

Figure 4:
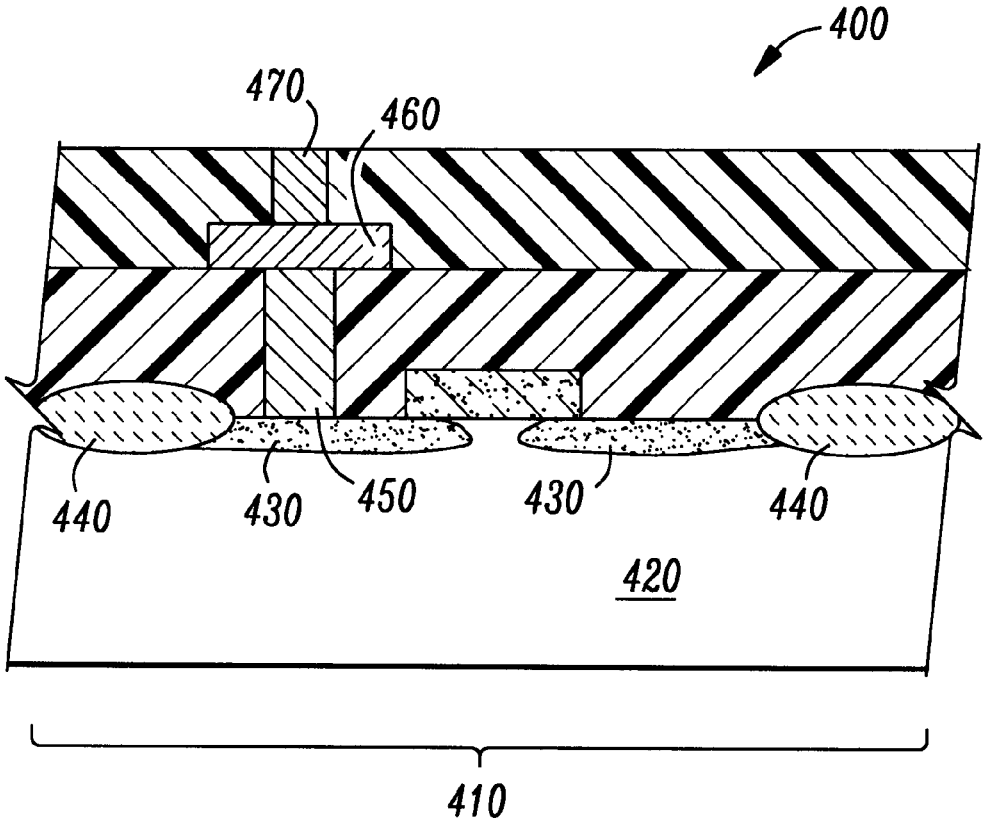
FIG. 4 illustrates a partial sectional view of a conventional integrated circuit that can be manufactured using a semiconductor wafer polishing head constructed in accordance with the principles of the present invention.

Based on the foregoing discussion, it can readily be seen that the apparatus and method provided by the present invention can be used to improve the manufacturing of a conventional integrated circuit, which is illustrated in FIG. 4. FIG. 4 is a partial sectional view of a conventional integrated circuit 400. In this particular sectional view, there is illustrated an active device 410 that comprises a tub region 420, source/drain regions 430 and field oxides 440, which together may form a conventional transistor, such as a CMOS, PMOS, NMOS or bi-polar transistor. A contact plug 450 contacts the active device 410. The contact plug 450 is, in turn, contacted by a trace 460 that connects to other regions of the integrated circuit, which are not shown. A VIA 470 contacts the trace 460, which provides electrical connection to subsequent levels of the integrated circuit 400. Following a polishing process during which a substrate of the integrated circuit 400 is polished, the polishing pad may be conditioned. After several conditioning cycles, the conditioning wheel may encounter wear as discussed above. In such instances, the indicator registers the excess current and the operator replaces the conditioning wheel. As a consequence, replacement timing of the conditioning wheel is dictated by the excess current rather than by the empirical data discussed above. As a result, the polishing pad is maintained in a better and more uniform condition, which, in turn, provides for an overall improved polishing process of the various layers within the integrated circuit 400.

Thus, a conditioning wheel status indicator has been described that provides a visual or other indication that a conditioning wheel has reached its useable lifetime. The useable lifetime is indicated by an increase in the amount of amperage needed to maintain rotation of the conditioning wheel at the prescribed rotation rate.

Although the present invention has been described in detail, those skilled in the art should understand that they can make various changes, substitutions and alterations herein without a departing from the spirit and scope of the invention in its broadest form.

What is claimed is:

1. For use with a polishing apparatus having a conditioning wheel and a polishing pad, a conditioning wheel status indicator, comprising:

a drive motor coupled to the conditioning wheel and configured to rotate the conditioning wheel against the polishing pad at a prescribed rotation rate;

an ammeter coupled to the drive motor and configured to measure a current of the drive motor, the current being a nominal current when the conditioning wheel is new; and an indicator coupled to the ammeter and configured to register an excess current of the drive motor that exceeds the nominal current and that occurs when the conditioning wheel has incurred an undesirable degree of wear.

2. The conditioning wheel status indicator as recited in claim 1 further comprising a motor tachometer coupled to the drive motor and configured to measure a rotation rate of the drive motor.

3. The conditioning wheel status indicator as recited in claim 2 further comprising a feedback loop coupled to the tachometer and to the drive motor, the feedback loop configured to maintain the rotation rate at the prescribed rotation rate.

4. The conditioning wheel status indicator as recited in claim 1 wherein the excess current is about twice the nominal current.

5. The conditioning wheel status indicator as recited in claim 4 wherein the excess current is about 1.7 times the nominal current.

6. The conditioning wheel status indicator as recited in claim 1 further comprising:

a platen tachometer;

a platen motor, the platen motor coupled to a polishing platen of the polishing apparatus and to the platen tachometer, the platen motor configured to rotate the polishing platen at a prescribed platen rotation rate;

a platen ammeter coupled to the platen motor and configured to measure a platen motor current, the platen motor current being a nominal platen motor current when the conditioning wheel is new; and an excess platen motor current indicator coupled to the platen ammeter and configured to register an excessive drive current of the platen drive motor when the conditioning wheel has incurred the undesirable degree of wear.

7. The conditioning wheel status indicator as recited in claim 1 further comprising an excess current sensor and a rejection indicator light, the excess current sensor configured to sense the current and to illuminate the rejection indicator light when the current equals or exceeds the excess current.

8. A method for determining when a conditioning wheel is worn, comprising:

rotating the conditioning wheel against a polishing pad at a prescribed rotation rate with a drive motor;

measuring a current of the drive motor with an ammeter;

determining a nominal current of the drive motor when the conditioning wheel is new; and replacing the conditioning wheel when the ammeter registers an excess current that exceeds the nominal current and that occurs when the conditioning wheel has incurred an undesirable degree of wear.

9. The method as recited in claim 8 further comprising measuring a rotation rate of the drive motor with a tachometer.

10. The method as recited in claim 8 further comprising maintaining the rotation rate at the prescribed rotation rate with a feedback loop coupled to the ammeter and to the drive motor.

11. The method as recited in claim 8 wherein replacing includes replacing when the excess current is about twice the nominal current.

12. The method as recited in claim 11 wherein replacing includes replacing when the excess current is about 1.7 times the nominal current.

13. The method as recited in claim 8 further comprising:

rotating a polishing platen of the polishing apparatus with a platen motor at a prescribed platen rotation rate;

measuring a platen motor current of the platen motor, the platen motor current being a nominal platen motor current when the conditioning wheel is new; and replacing the conditioning wheel when the platen motor current registers an excess platen motor current that exceeds the nominal platen motor current and that occurs when the conditioning wheel has incurred the undesirable degree of wear.

14. The method as recited in claim 8 further comprising sensing the current with a excess current sensor and illuminating a rejection indicator light when the current equals or exceeds the excess current.

15. A method of manufacturing an integrated circuit, comprising:

forming an active device on a semiconductor wafer;

forming a substrate over the active device;

polishing the substrate with a polishing tool having a polishing platen and a polishing pad;

rotating a conditioning wheel against the polishing pad at a prescribed rotation rate with a drive motor;

measuring a current of the drive motor with an ammeter;

determining a nominal current of the drive motor when the conditioning wheel is new; and replacing the conditioning wheel when the ammeter registers an excess current that exceeds the nominal current and that occurs when the conditioning wheel has incurred an undesirable degree of wear.

16. The method as recited in claim 15 further comprising measuring a rotation rate of the drive motor with a tachometer.

17. The method as recited in claim 16 further comprising maintaining the rotation rate at the prescribed rotation rate with a feedback loop coupled to the ammeter and to the drive motor.

18. The method as recited in claim 15 wherein rejecting includes rejecting when the excess current is about twice the nominal current.

19. The method as recited in claim 18 wherein rejecting includes rejecting when the excess current is about 1.7 times the nominal current.

20. The method as recited in claim 15 further comprising:

rotating a polishing platen of the polishing apparatus with a platen motor at a prescribed platen rotation rate;

measuring a platen motor current of the platen motor, the platen motor current being a nominal platen motor current when the conditioning wheel is new; and replacing the conditioning wheel when the platen motor current registers an excess platen motor current that exceeds the nominal platen motor current and that occurs when the conditioning wheel has incurred an undesirable degree of wear.

21. The method as recited in claim 15 wherein the replacing includes illuminating a rejection indicator light when the current equals or exceeds the excess current.

22. An integrated circuit as made by the method recited in claim 15.

23. The integrated circuit as recited in claim 22 wherein the integrated circuit includes a transistor selected from the group consisting of:

a CMOS transistor, an NMOS transistor, a PMOS transistor, and a bipolar transistor.

24. The integrated circuit as recited in claim 22 further comprising electrical interconnects formed within the integrated circuit.

25. The integrated circuit as recited in claim 24 wherein the electrical interconnects include an electrical interconnect selected from the group consisting of:

a contact plug, a VIA, and a trace.

* * * * *